US007597542B2

(12) United States Patent
Noshi et al.

(10) Patent No.: US 7,597,542 B2
(45) Date of Patent: Oct. 6, 2009

(54) METHODS AND APPARATUS FOR CONTROLLING CONTACT WITHIN STATOR ASSEMBLIES

(75) Inventors: Hani Ikram Noshi, Greenville, SC (US); Steven E. Tomberg, Simpsonville, SC (US); Josef Scott Cummins, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 462 days.

(21) Appl. No.: 11/214,500

(22) Filed: Aug. 30, 2005

(65) Prior Publication Data

US 2007/0048131 A1 Mar. 1, 2007

(51) Int. Cl.
*F04D 29/34* (2006.01)

(52) U.S. Cl. ..... 416/190; 416/215; 416/248; 415/119

(58) Field of Classification Search ..... 415/119; 416/192, 193 R, 193 A, 190, 248
See application file for complete search history.

(56) References Cited

U.S. PATENT DOCUMENTS 4,083,648 A 4/1978 Asplund
5,127,793 A 7/1992 Walker et al.
5,513,955 A 5/1996 Barcza
5,639,212 A 6/1997 Schaefer et al.
6,520,743 B2 2/2003 Arilla et al.
6,832,896 B1 12/2004 Goga et al.
6,984,112 B2 1/2006 Zhang et al.
7,094,029 B2 8/2006 Taylor et al.
7,125,222 B2 10/2006 Cormier et al.
7,147,440 B2 12/2006 Benjamin et al.
2006/0013691 A1 * 1/2006 Athans et al. ..... 416/193 A
2006/0088419 A1 4/2006 Hermiston et al.

* cited by examiner

*Primary Examiner*—Edward Look
*Assistant Examiner*—Dwayne J White
(74) *Attorney, Agent, or Firm*—Armstrong Teasdale LLP

(57) ABSTRACT

A method enables a stator assembly for a turbine engine to be assembled. The method comprises forming a recess within a portion of each base, and coupling the stator vanes within the turbine engine in a circumferentially-spaced arrangement such that the recessed portion of each base facilitates reducing excitation responses of each of the plurality of stator vanes during engine operation.

20 Claims, 3 Drawing Sheets

METHODS AND APPARATUS FOR CONTROLLING CONTACT WITHIN STATOR ASSEMBLIES

BACKGROUND OF THE INVENTION

This application relates generally to turbine engines and, more particularly, to methods and apparatus for controlling contact within turbine engine stator assemblies.

At least some known rotor assemblies include at least one row of circumferentially-spaced rotor blades. Each row of rotor blades is positioned between a pair of axially-spaced rows of circumferentially-spaced stator vanes or blades. At least some known stator vanes are fabricated with a base and an integrally-formed airfoil that extends radially outward from the base. Each base is configured to couple the stator vanes within the engine such that the stator vanes extend radially through a flow path defined within the rotor assembly.

Within at least some known stator assemblies, the base of each stator vanes is substantially wedge-shaped or square based such that a radially outer surface of the base may have an arcuate length that is longer than a corresponding length of a radially inner surface of the base. The wedge shape facilitates coupling the stator vanes circumferentially within the stator assembly. However, within such stator vanes the geometry of the base also makes control of contact between adjacent stator vanes, known as circumferential contact, and between each stator vanes and the casing, known as axial contact, difficult to accurately predict. As a result, during rotor operation excitation responses generated by such stator vanes often do not match predicted experimental frequencies. Over time, the increased excitation responses may result in shortening the useful life of the stator vanes.

BRIEF SUMMARY OF THE INVENTION

In one aspect, a method for assembling a stator assembly for a turbine engine is provided. The method comprises forming a recess within a portion of each base, and coupling the stator vanes within the turbine engine in a circumferentially-spaced arrangement such that the recessed portion of each base facilitates reducing excitation responses of each of the plurality of stator vanes during engine operation.

In another aspect, a stator vane for a turbine engine is provided. The stator vane includes a base and an airfoil. The base is configured to couple the stator vane within the turbine engine. The airfoil extends radially outward from the base. The base includes a pair of circumferentially-spaced sides coupled together by an upstream side and a downstream side, wherein at least a portion of the base is recessed to facilitate reducing excitation responses of the vane during engine operation.

In a further aspect, a rotor assembly including a rotor shaft and a plurality of stator vanes circumferentially-spaced around the rotor shaft is provided. Each stator vane includes a base and an integrally-formed airfoil extending radially outward from the base. Each base includes a pair of circumferentially-spaced sides coupled together by an upstream side and a downstream side, wherein at least a portion of each base is recessed to facilitate reducing excitation responses of each of the plurality of stator vanes during rotor operation.

DETAILED DESCRIPTION OF THE INVENTION

Figure 1:
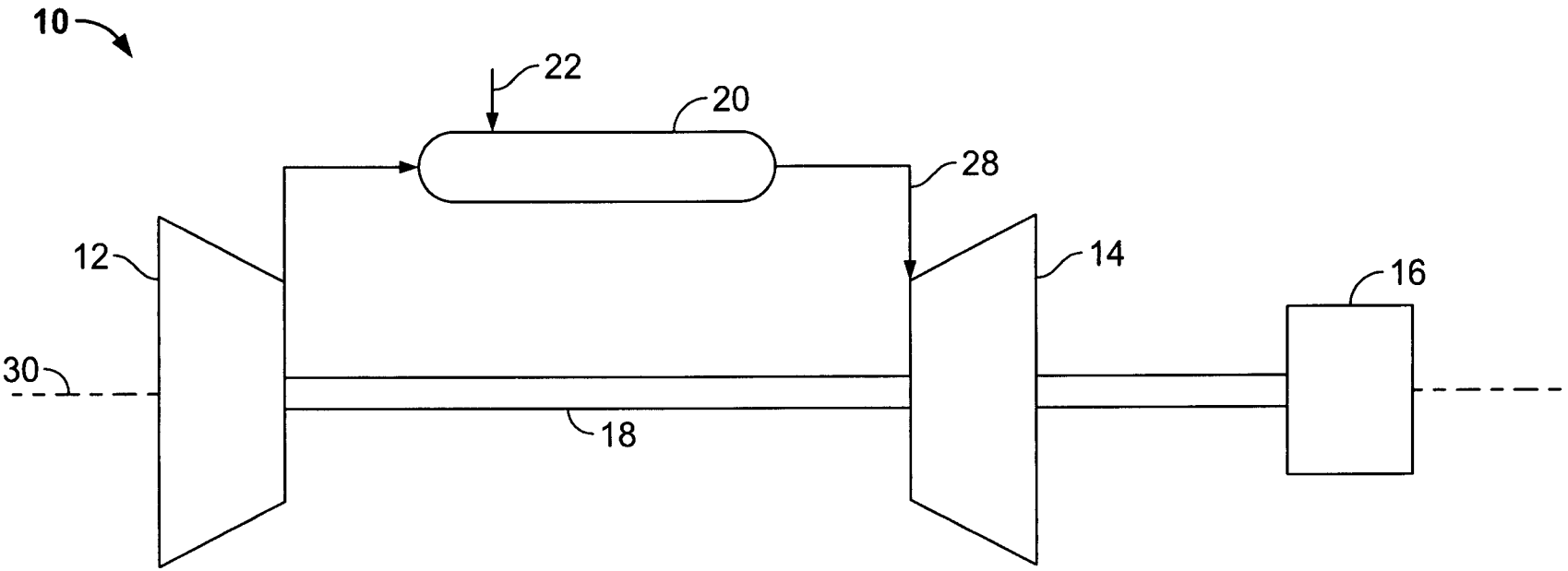
FIG. 1 is schematic illustration of an exemplary gas turbine engine.

FIG. 1 is a schematic illustration of an exemplary gas turbine engine 10 coupled to an electric generator 16. In the exemplary embodiment, gas turbine system 10 includes a compressor 12, a turbine 14, and generator 16 arranged in a single monolithic rotor or shaft 18. In an alternative embodiment, shaft 18 is segmented into a plurality of shaft segments, wherein each shaft segment is coupled to an adjacent shaft segment to form shaft 18. Compressor 12 supplies compressed air to a combustor 20 wherein the air is mixed with fuel 22 supplied thereto. In one embodiment, engine 10 is a 6C gas turbine engine commercially available from General Electric Company, Greenville, S.C.

In operation, air flows through compressor 12 and compressed air is supplied to combustor 20. Combustion gases 28 from combustor 20 propels turbines 14. Turbine 14 rotates shaft 18, compressor 12, and electric generator 16 about a longitudinal axis 30.

Figure 2:
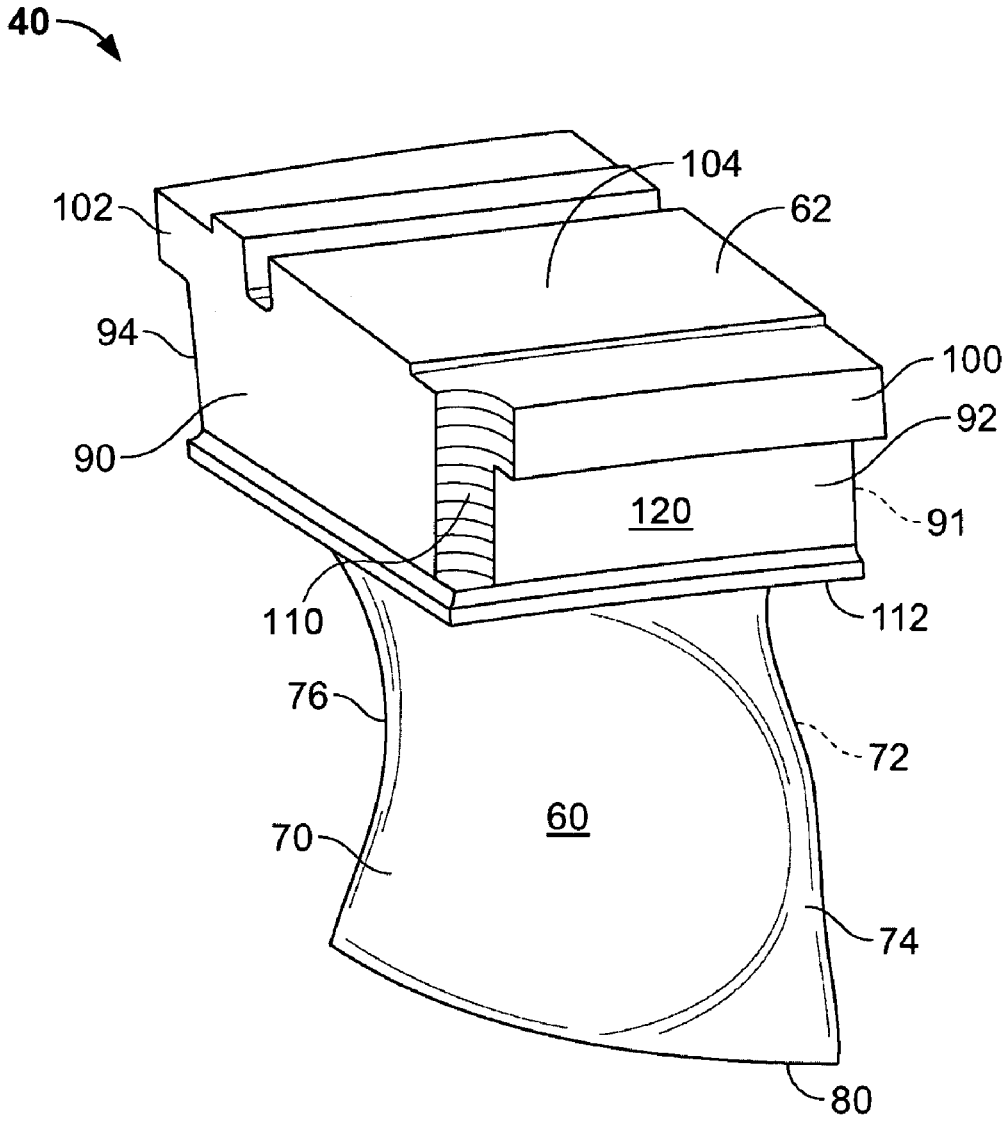
FIG. 2 is an enlarged perspective view of an exemplary stator vane that may be used with the gas turbine engine shown in FIG. 1.
Figure 3:
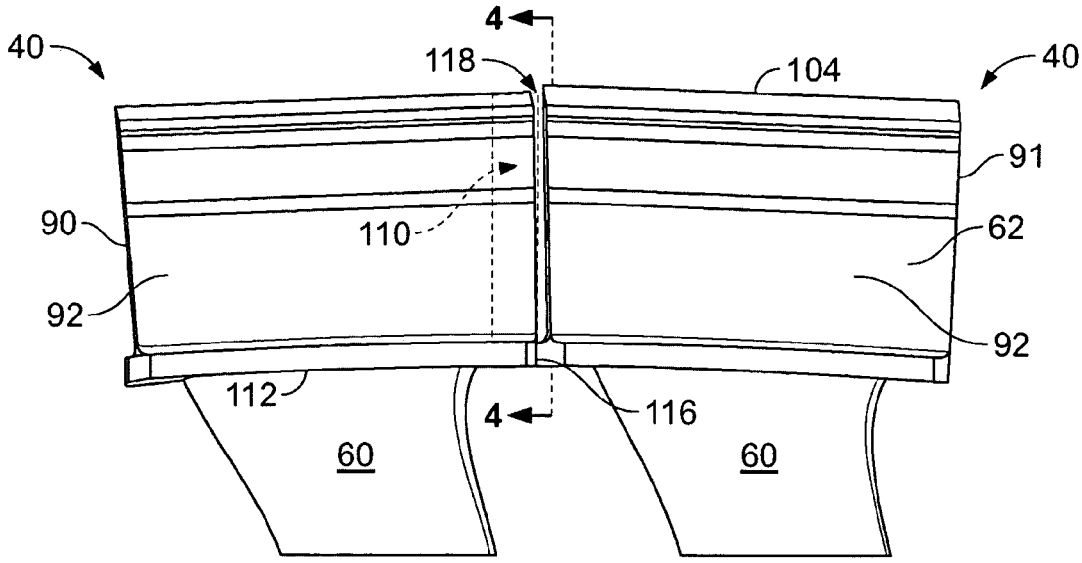
FIG. 3 is a front view of a pair of the stator vanes shown in FIG. 2 and illustrates a relative circumferential orientation of adjacent stator vanes as positioned when assembled within an engine, such as the gas turbine engine shown in FIG. 1.
Figure 4:
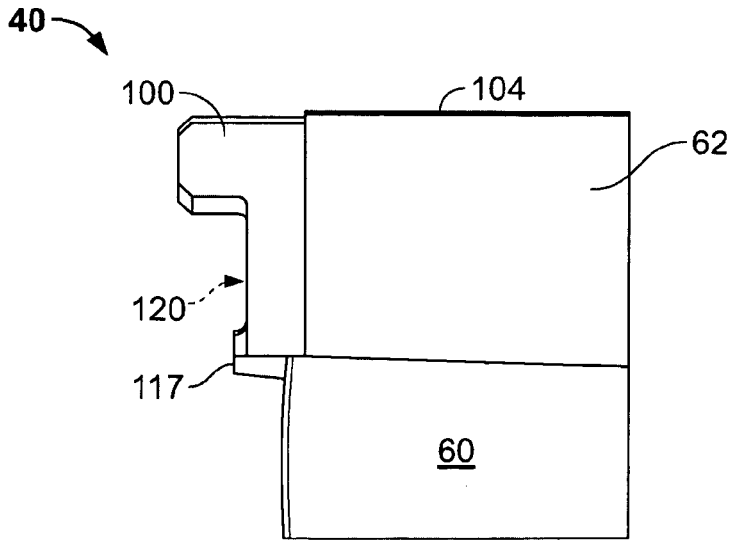
FIG. 4 is a cross-sectional view of the pair of stator vanes shown in FIG. 3 and taken along line 4-4.

FIG. 2 is an enlarged perspective view of an exemplary stator vane 40 that may be used with gas turbine engine 10 (shown in FIG. 1). More specifically, in the exemplary embodiment, stator vane 40 is coupled within a compressor, such as compressor 12 (shown in FIG. 1). FIG. 3 is a front view of a pair of stator vanes 40 and illustrates a relative circumferential orientation of adjacent stator vanes 40 when assembled within a stator assembly, used with a rotor assembly such as gas turbine engine 10 (shown in FIG. 1). FIG. 4 is a cross-sectional view of the pair of stator vanes 40 and taken along line 4-4 (shown in FIG. 3). In the exemplary embodiment, each stator vane 40 has been modified to include the features described herein.

When assembled within the stator assembly, each stator vane 40 is coupled to an engine casing (not shown) that extends circumferentially around a rotor shaft, such as shaft 18 (shown in FIG. 1). As is known in the art, when fully assembled, each circumferential row of stator vanes 40 is located axially between adjacent rows of rotor blades (not shown). More specifically, stator vanes 40 are oriented to channel a fluid flow through the stator assembly in such a manner as to facilitate enhancing engine performance. In the exemplary embodiment, circumferentially adjacent stator vanes 40 are identical and each extends radially across a flow path defined within the rotor and stator assemblies. Moreover, each stator vane 40 includes an airfoil 60 that extends radially outward from, and in the exemplary embodiment, is formed integrally with, a base or platform 62.

Each airfoil 60 includes a first sidewall 70 and a second sidewall 72. First sidewall 70 is convex and defines a suction side of airfoil 60, and second sidewall 72 is concave and defines a pressure side of airfoil 60. Sidewalls 70 and 72 are joined together at a leading edge 74 and at an axially-spaced trailing edge 76 of airfoil 60. More specifically, airfoil trailing edge 76 is spaced chord-wise and downstream from airfoil leading edge 74. First and second sidewalls 70 and 72, respectively, extend longitudinally or radially outward in span from its root positioned adjacent base 62 to an airfoil tip 80.

Base 62 facilitates securing stator vanes 40 to the casing. In the exemplary embodiment, base 62 is known as a "square-faced" base and includes a pair of circumferentially-spaced sides 90 and 91 that are connected together by an upstream face 92 and a downstream face 94. Alternatively, base 62 could include an arcuate surface. In the exemplary embodiment, sides 90 and 91 are identical and are substantially parallel to each other. In an alternative embodiment sides 90 and 91 are not parallel. Moreover, in the exemplary embodiment, upstream face 92 and downstream face 94 are substantially parallel to each other.

A pair of integrally-formed hangers 100 and 102 extend from each respective face 92 and 94. Hangers 100 and 102, as is known in the art, engage the casing to facilitate securing stator vane 40 within the stator assembly. In the exemplary embodiment, each hanger 100 and 102 extends outwardly from each respective face 92 and 94 adjacent a radially outer surface 104 of base 62.

To facilitate controlling contact between circumferentially-adjacent stator vanes 40 during rotor operation, in the exemplary embodiment, at least one of circumferential sides 90 and 91 includes a recessed or scalloped portion 110 that extends partially between radially outer surface 104 and a radially inner surface 112 of base 62. Recessed portion 110 is sized and oriented to facilitate controlling an amount of contact between adjacent stator vanes 40 during rotor operation. More specifically, in the exemplary embodiment, recessed portion 110 extends from radially outer surface 104 towards radially inner surface 112 such that a hinge 116 is created adjacent radially inner surface 112. Accordingly, when adjacent stator vanes are coupled within the stator assembly, a gap 118 is defined between adjacent stator vanes 40 and contact between the stator vanes is limited being only along hinge 116. As a result, line contact between adjacent stators 40 is driven along the rotor assembly flow path. Alternatively, line contact may be anywhere between hinge 116 and side 91.

In addition, to facilitate controlling contact between each respective stator vane 40 and the engine casing during rotor operation, in the exemplary embodiment, upstream face 92 includes a recessed portion 120 that extends across face 92 between sides 90 and 91. Recessed portion 120 is sized and oriented to facilitate controlling an amount of contact between stator vane 40, along face 92, and the engine casing. More specifically, in the exemplary embodiment, recessed portion 120 extends from hanger 100 to a hinge 117. As a result, line contact between each stator vane 40 and the engine casing is controlled. Alternatively, line contact may be anywhere along portion 120.

The combination of recessed portions 120 and 110 facilitates controlling stator-to-stator contact and stator-to-casing contact. The enhanced control of the contact facilitates each stator base 62 being defined more accurately such that the stator vanes natural frequencies can be optimized more accurately to match predicted expermimental frequencies. Moreover, excitation responses induced within each stator vane 40 are facilitated to be reduced, thus resulting in fewer component failures and extending a useful life of the stator vanes.

The above-described stator vanes provide a cost-effective and reliable method for optimizing performance of a rotor assembly. More specifically, each stator vane includes recessed portions that facilitate controlling circumferential and axial contact with each stator vane such that excitation responses induced within each stator vane during engine operation are facilitated to be reduced. As a result, the redefined base geometry facilitates extending a useful life of the stator assembly and improving the operating efficiency of the gas turbine engine in a cost-effective and reliable manner.

Exemplary embodiments of stator vanes and stator assemblies are described above in detail. The stator vanes are not limited to the specific embodiments described herein, but rather, components of each stator vane may be utilized independently and separately from other components described herein. For example, each stator vane recessed portion can also be defined in, or used in combination with, other stator vanes or with other stator or rotor assemblies, and is not limited to practice with only stator vane 40 as described herein. Rather, the present invention can be implemented and utilized in connection with many other vane, stator, and rotor configurations.

While the invention has been described in terms of various specific embodiments, those skilled in the art will recognize that the invention can be practiced with modification within the spirit and scope of the claims.

What is claimed is:

1. A method for assembling a stator assembly for a turbine engine, said method comprising:

providing a plurality of stator vanes that each include a base and an integrally-formed airfoil that extends radially outward from the base;

forming a scalloped portion within a portion of each base; and coupling the stator vanes within the turbine engine in a circumferentially-spaced arrangement such that the scalloped portion defined within each base facilitates controlling contact between a first stator vane of said plurality of stator vanes and at least one of an adjacent second stator vane, and facilitates reducing excitation responses of each of the plurality of stator vanes during engine operation.

2. A method in accordance with claim 1 wherein coupling the stator vanes within the turbine engine comprises coupling circumferentially-adjacent stator vanes within the turbine engine such that the scalloped portion defined within each base facilitates controlling contact between the circumferentially-adjacent stator vanes.

3. A method in accordance with claim 1 wherein coupling the stator vanes within the turbine engine comprises coupling each stator vane to a casing extending circumferentially within the engine.

4. A method in accordance with claim 3 wherein coupling each stator vane to a casing extending circumferentially within the engine comprises coupling each stator vane to the casing such that each base scalloped portion facilitates controlling contact between a portion of each stator vane and the casing during engine operation.

5. A method in accordance with claim 1 wherein forming a scalloped portion within a portion of each base comprises forming the scalloped portion within each base to facilitate more accurate predictions of resonant responses within each stator vane during engine operation.

6. A method in accordance with claim 1 wherein forming a scalloped portion within a portion of each base comprises forming the scalloped portion within the base such that each scalloped portion extends from a radially outer surface of the base towards a radially inner surface of the base.

7. A plurality of stator vanes for a turbine engine, each of said stator vane comprising:

a base configured to couple said stator vane within the turbine engine; and an airfoil extending radially outward from said base, said base comprising a pair of circumferentially-spaced sides coupled together by an upstream side and a downstream side, wherein at least a portion of said base comprises a scalloped portion that is configured to facilitate controlling contact between a first of said plurality of stator vanes and at least one of a second stator vane, and facilitates reducing excitation responses of said vane during engine operation.

8. A stator vane in accordance with claim 7 wherein said scalloped portion of said base facilitates controlling an amount of contact with said stator vane and an adjacent stator vane during engine operation.

9. A stator vane in accordance with claim 7 wherein said stator vane is coupled to a casing, said scalloped portion of said base facilitates controlling contact between said stator vane and the casing during engine operation.

10. A stator vane in accordance with claim 7 wherein said scalloped portion facilitates more accurate predictions of resonant responses within said vane during engine operation.

11. A stator vane in accordance with claim 7 wherein said scalloped portion is defined within at least one of said circumferentially-spaced sides to facilitate limiting contact between said stator base and a circumferentially-adjacent stator base.

12. A stator vane in accordance with claim 7 wherein said scalloped portion is defined within one of said base upstream side and said base downstream side to facilitate controlling contact between said stator base and an engine casing.

13. A stator vane in accordance with claim 7 wherein said base further comprises a radially outer surface and a radially inner surface, said scalloped portion extends from said radially outer surface towards said radially inner surface.

14. A rotor assembly comprising:

a rotor shaft; and a plurality of stator vanes circumferentially-spaced around said rotor shaft, each said stator vane comprising a base and an integrally-formed airfoil extending radially outward from said base, each said base comprising a pair of circumferentially-spaced sides coupled together by an upstream side and a downstream side, wherein at least a portion of each said base comprises a scalloped portion that facilitates controlling contact between a first of said plurality of stator vanes and at least one of a second stator vane, and facilitates reducing excitation responses of each of said plurality of stator vanes during rotor operation.

15. A rotor assembly in accordance with claim 14 wherein each said scalloped portion of each said base facilitates controlling an amount of contact between circumferentially-adjacent pairs of said plurality of stator vanes during rotor operation.

16. A rotor assembly in accordance with claim 15 wherein each said scalloped portion is defined within at least one of said base circumferentially-spaced sides.

17. A rotor assembly in accordance with claim 14 further comprising a casing extending around said rotor shaft, each of said plurality of stator vanes is coupled to said casing and extends radially inward therefrom, each said scalloped portion of each of said stator vane bases facilitates controlling contact between each of said plurality of stator vanes and said casing during rotor operation.

18. A rotor assembly in accordance with claim 17 wherein each said scalloped portion is defined within one of said upstream side and said downstream side of each of said stator vane bases.

19. A rotor assembly in accordance with claim 14 wherein each said stator vane scalloped portion facilitates more accurate predictions of resonant responses within said plurality of stator vanes during rotor operation.

20. A rotor assembly in accordance with claim 14 wherein each said base further comprises a radially outer surface and a radially inner surface, each said scalloped portion extends from said base radially outer surface towards said base radially inner surface.

* * * * *

UNITED STATES PATENT AND TRADEMARK OFFICE

CERTIFICATE OF CORRECTION

PATENT NO. : 7,597,542 B2
APPLICATION NO. : 11/214500
DATED : October 6, 2009
INVENTOR(S) : Noshi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 653 days.

Signed and Sealed this

Twenty-eighth Day of September, 2010

David J. Kappos

David J. Kappos
*Director of the United States Patent and Trademark Office*